United States Patent [19]

Godbersen et al.

[11] Patent Number: 5,061,115

[45] Date of Patent: Oct. 29, 1991

[54] ADJUSTABLE AUTOMATIC FLOATING TROWEL APPARATUS FOR SLIP FORMING MACHINES

[75] Inventors: Gary L. Godbersen; Dwayne D. Salmon, both of Ida Grove, Iowa

[73] Assignee: Gomaco Corp., Ida Grove, Iowa

[21] Appl. No.: 549,829

[22] Filed: Jul. 9, 1990

[51] Int. Cl.[5] ..... E01C 19/40

[52] U.S. Cl. ..... 404/102; 404/113; 404/119; 404/120

[58] Field of Search ..... 404/102, 105, 106, 113, 404/119, 120

[56] References Cited

U.S. PATENT DOCUMENTS

| | | | |
|---|---|---|---|
| 2,556,503 | 6/1951 | Nelson | 404/106 X |
| 3,147,678 | 9/1954 | Lewis | 404/102 |
| 3,404,611 | 10/1968 | Wilson | 404/120 |
| 3,604,325 | 9/1971 | Borges | 404/120 |
| 4,758,114 | 7/1988 | Artzberger | 404/119 |

FOREIGN PATENT DOCUMENTS 2080374B 10/1983 United Kingdom .

OTHER PUBLICATIONS

Copy of a letter dated May 22, 1990 from Gomaco Corporation with attached copies of 2—8×10" photographs of prior auto float pan designs; a 2-page brochure-type document entitled Gomaco—Auto Float.

*Primary Examiner*—George A. Suchfield
*Attorney, Agent, or Firm*—Henderson & Sturm

[57] ABSTRACT

An attachment for a slip forming paver for automatically finishing concrete surfaces which includes an elongated concrete smoothing trowel member. A mechanism is provided for oscillating the trowel member back and forth along its longitudinal axis and includes another mechanism for moving the oscillating mechanism and the trowel member itself transversely with respect to such longitudinal axis. The trowel member is pivotally mounted to the oscillating mechanism by a pair of levers and a winch and cable mechanism is provided for selectively adjusting the effective weight of the trowel member with respect to the concrete being smoothed by the trowel member. A turnbuckle arrangement is provided for adjustably maintaining the lower surface of the trowel member straight and smooth by applying tension forces thereon. To the extent that the weight adjusting mechanism and the turnbuckle arrangement move the trowel member out of balance, a single weight is provided, on the end opposite the winch. The weight is positioned to balance the float pan around center.

10 Claims, 2 Drawing Sheets

ADJUSTABLE AUTOMATIC FLOATING TROWEL APPARATUS FOR SLIP FORMING MACHINES

TECHNICAL FIELD

The present invention relates generally to attachments for slip forming machines and more particularly to an automatic floating trowel for smoothing concrete during the slip forming process which is attached to a slip forming machine.

BACKGROUND ART

Slip forming machines are usually used to build highways of a type which are constructed of concrete. One such device is shown in U.S. Pat. No. 4,073,592 to Godbersen, which is incorporated herein by reference.

These slip forming paver machines often have various stages of moving and smoothing concrete while inserting, reinforcing for dowel bars or the like. In the past, the concrete has not always been completely as smooth as possible or desirable, so the concrete would be manually smoothed to some extent.

Within the last decade or so, it has been common to put a trowel on the back end of a slip forming machine and to reciprocate it in one direction while moving it back and forth across the pavement in another direction. This device can be seen, for example, in United Kingdom Patent No. GB 2080374B which was patented in 1983, which patent is also incorporated herein by reference.

One of the problems associated with a finishing trowel of the automatic type is that it has been difficult to keep the lower surface thereof flat and smooth. If sheet metal is used for such a trowel which is heavy enough to keep it flat and smooth, it increases the cost of manufacture considerably and may be too heavy for proper concrete finishing under certain circumstances.

Furthermore, the prior art automatic finishing trowels have not been easily adjustable to apply the desired amount of pressure against the concrete being smoothed. The optimum pressure against the concrete being smooth varies to some extent, depending upon the conditions such as the wetness or dryness of the concrete.

Furthermore, the prior art automatic trowel members for slip forming machines often are difficult to balance and retain in a balanced fashion and when not balanced, they do not operate in an optimum fashion. Consequently, there is a need for an apparatus to assist in adjusting the balance for these devices.

DISCLOSURE OF THE INVENTION

The present invention relates generally to an attachment for a slip forming paver for automatically finishing concrete surfaces which includes an elongated concrete smoothing trowel member. A mechanism is provided for oscillating the trowel member back and forth along its longitudinal axis and includes another mechanism for moving the oscillating mechanism and the trowel member itself transversely with respect to such longitudinal axis. The trowel member is pivotally mounted to the oscillating mechanism by a pair of levers and a winch and cable mechanism is provided for selectively adjusting the effective weight of the trowel member with respect to the concrete being smoothed by the trowel member. A turnbuckle arrangement is provided for adjustably maintaining the lower surface of the trowel member straight and smooth by applying tension forces thereon. To the extent that the weight adjusting mechanism and the turnbuckle arrangement move the trowel member out of balance, a weight is provided on the end opposite the winch by positioning it on the trowel member for such balancing purposes.

An object of the present invention is to provide an improved apparatus for automatically finishing concrete surfaces on any slip form paving machine.

Another object of the present invention is to provide a mechanism to adjust a trowel member on a device of the aforementioned type to keep the bottom thereof flat and smooth.

Another object of the present invention is to provide a mechanism on the aforementioned device for adjusting the pressure on the trowel member against the concrete being smoothed.

A still further object of the present invention is to provide a mechanism for providing proper balance of the trowel member.

Other objects, advantages, and novel features of the present invention will become apparent from the following detailed description of the invention when considered in conjunction with the accompanying drawings.

BEST MODE FOR CARRYING OUT THE INVENTION

Figure 1:
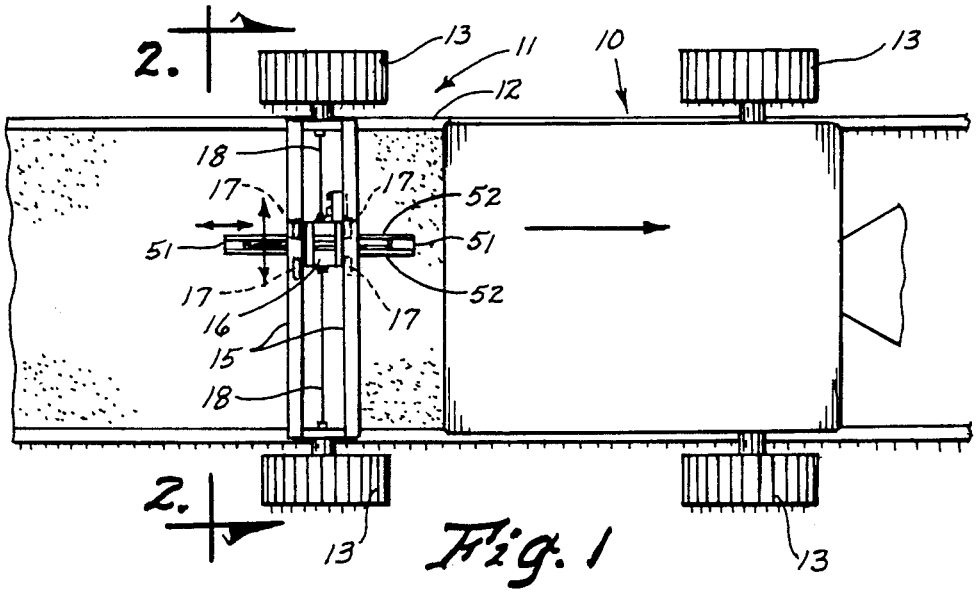
FIG. 1 is a top plan view of a slip form paver having the concrete smoothing apparatus of the present invention attached thereto.
Figure 2:
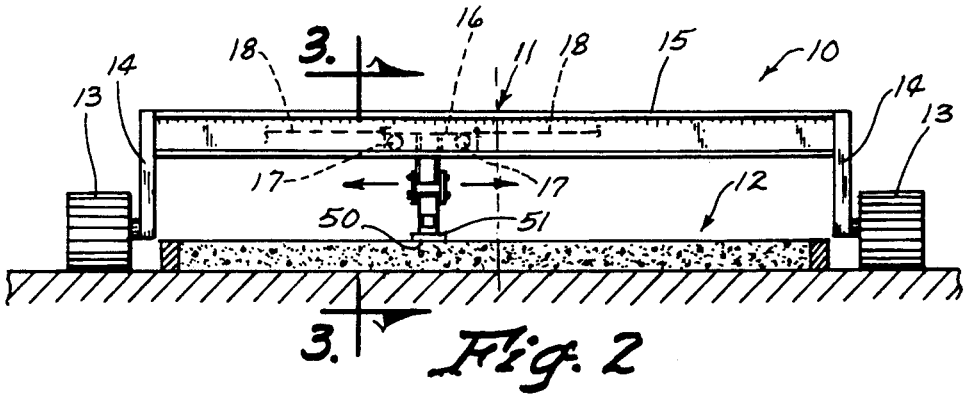
FIG. 2 is a cross sectional view taken along line 2—2 of FIG. 1.

Referring now to the drawings wherein like reference numerals designate identical or corresponding parts throughout the several views, FIG. 1 shows a slip forming paver (10) having a finishing concrete attachment (11) attached thereto which is constructed in accordance with the present invention. The slip forming paver (10) has a frame (12) to which all of the slip forming paver is attached, including the tracks (13) for moving the slip forming paver forward or rearwardly and to which the beams (14) and (15) of the finishing attachment (11) is connected, for example, as shown in FIG. 2.

Figure 3:
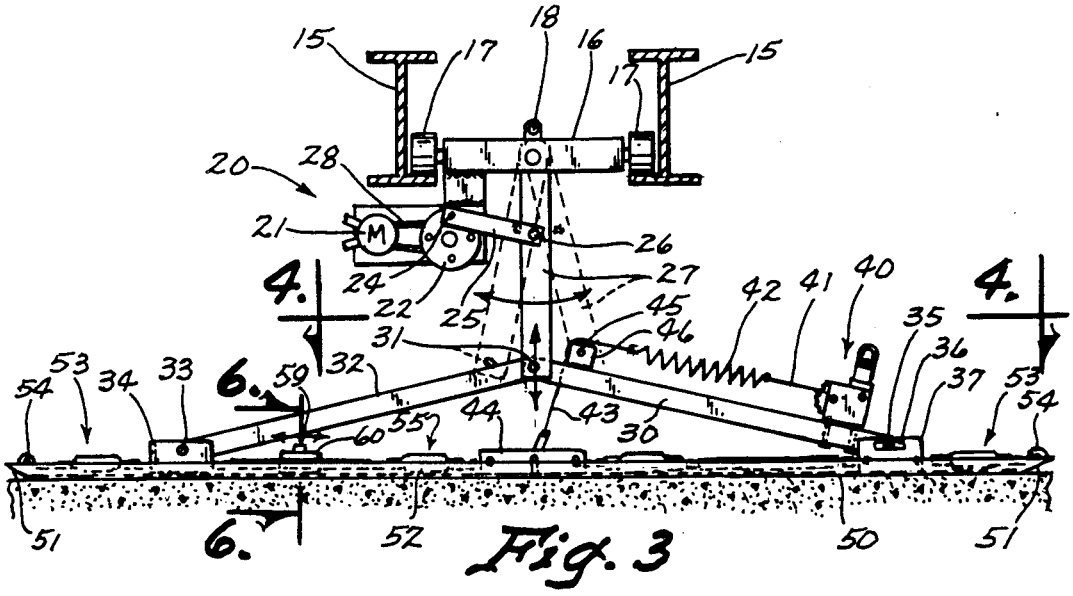
FIG. 3 is an enlarged cross sectional view taken along line 3—3 of FIG. 2.

Referring to FIG. 3, it is shown that a trolley member (16) has trolley wheels (17) attached to the ends thereof for permitting the trolley (16) to move back and forth along the beams (15).

An oscillating mechanism (20) includes a motor (21) which turns a crank (22) through a belt (28) and this crank (22) is pivotally attached at point (24) to a crank lever (25). This lever (25) is pivotally attached by a pin (26) to a downwardly extending lever (27) which is pivotally attached at the top to the trolley member (16).

A first member (30) is pivotally attached at the top thereof to the lever (27) by pin (31) and a second member (32) is pivotally attached to the top thereof also by pin (31) to the lever (27). The bottom of lever (32) is pivotally attached by a pin (33) in brackets (34) while the bottom of the lever (30) is pivotally attached by pin (35) in a slotted opening (36) in brackets (37).

A winch (40) is connected to the lower end of the member (30) and has a cable (41) extending therefrom to a tension spring (42) and then to a cable (43) which is ultimately attached to brackets (44). The cable (43) passes over an idler pulley (45) pivotally attached to the lever (30) by bracket (46).

Figure 4:
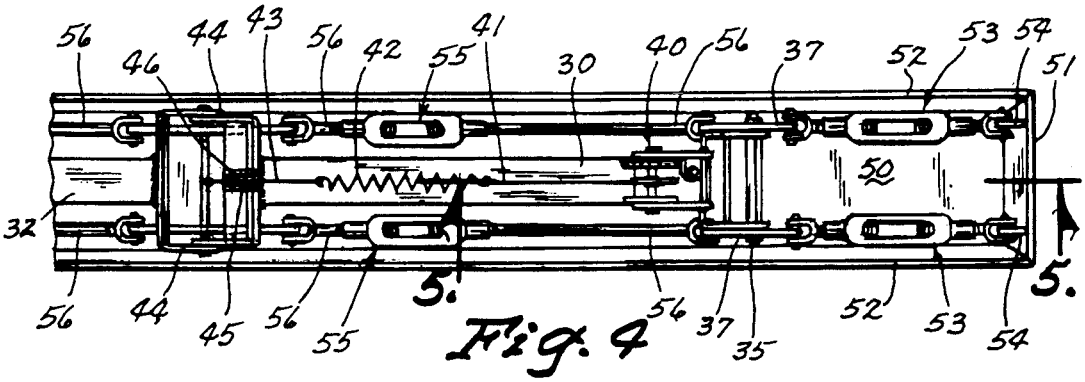
FIG. 4 is a view taken along line 4—4 of FIG. 3.
Figure 5:
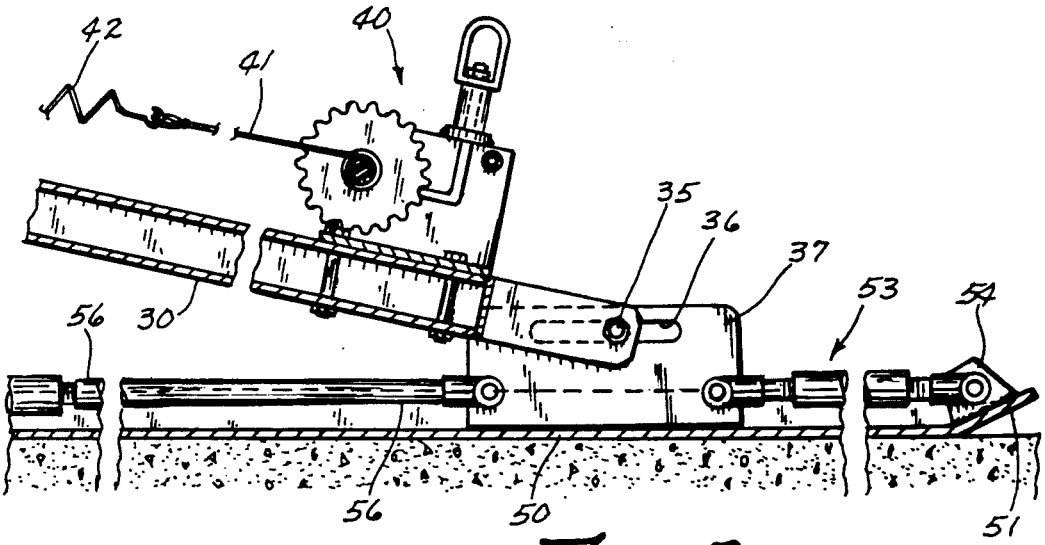
FIG. 5 is an enlarged partial cross sectional view taken along line 5—5 of FIG. 4.

Referring to FIGS. 4 and 5, it is noted that a trowel member (50) has an upstanding end (51) at each end and sidewalls (52) to substantially prevent concrete being finished from getting on top of the trowel member (50).

Brackets (37) have turnbuckles (53) pivotally attached thereto and these turnbuckles are also attached to tabs (54) on the ends of trowel member (50). Consequently, by turning the turnbuckle (53) in one direction, will tend to push the members (37) and (54) apart, while turning the turnbuckle (53) in an opposite rotary direction will tend to pull the members (37) and (54) together. Referring to FIGS. 3 and 4, it is noted that brackets (44) have turnbuckles (55) pivotally attached to each end thereof and the other end of the rightside turnbuckles (55) are pivotally attached to bracket (37) and the left side turnbuckles (55) are pivotally attached to brackets (34). These turnbuckles (55) also can be operated to be rotated in one direction to push the brackets (44) and (37) apart or push brackets (44) and (34) apart or, if rotated in an opposite direction can be made to pull brackets (44) and (37) or brackets (44) and (34) closer together.

Figure 6:
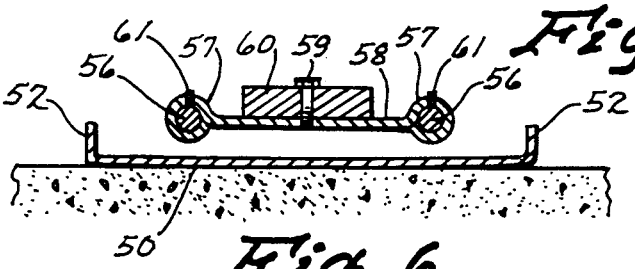
FIG. 6 is an enlarged cross sectional view taken along line 6—6 of FIG. 5.

Referring now to FIG. 6, rods (56) on the outer ends of turnbuckles (55) have connector flanges (57) extending therearound, and these flanges (57) are interconnected by a plate (58) having an opening in the center so that bolt (59) can extend through in threaded engagement with balancing weight (60). Set screws (61) are provided so that when the set screws are loosened, the weight (60) can be moved back and forth along the length of the rods (56) for balancing purposes.

In operation, as the slip forming paver (10) moves in a forward direction as indicated by the arrow to the right in FIG. 1, it will be noted that the trolley (16) is moved back and forth across the pavement (19) by a chain or cable arrangement (18) which is well known in this art. At the same time that this is done, the crank (20) operates to move the trowel member (50) back and forth in the direction of its longitudinal axis which is generally parallel to the forward direction of movement of the slip forming paver (10). FIG. 1 shows arrows indicating how the trowel member (50) moves back and forth across the pavement (19) while at the same time moving forwardly and rearwardly in a quicker oscillating motion. This of course will smooth the concrete (19) so that it does not have to be done by hand or, worse yet, be subjected to a more expensive grinding procedure after it hardens. Under certain conditions, it will be desirable to have less weight on the pan (50) and in such case, the winch (40) is operated to pull up on the bracket (44) as shown in FIG. 3. By pulling on the winch (40), it will pull on the cable (41), the tension spring (42) and the cable (43). If for any reason this causes the trowel member to be out of balance, then the balancing weight (60) can be moved to the proper position to keep the trowel member (50) balanced about its transverse centerline which would be generally an axis parallel to the axis of pin (31), but straight down and through the trowel member (50).

If for any reason the pan itself becomes wavy or unsmooth, the turnbuckles (53) and (55) can be effectively lengthened in order to essentially stretch or put the entire pan (50) under tension forces from one end, to the other. This tightening adjustment allows the pan (50) to be constructed of lighter material than would otherwise be possible.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

We claim:

1. Apparatus comprising:

a frame;

means for moving said frame in a forward direction;

means connected to said frame for slip forming concrete;

an elongated concrete smoothing trowel member having a longitudinal axis generally aligned with said direction of forward movement of said frame, said trowel members having a first end, a second end and an intermediate portion between the first and second end thereof;

means for oscillating said trowel member back and forth along said longitudinal axis;

means operably connected to a rear portion of said frame for moving said oscillating means and said trowel means transversely with respect to said longitudinal axis;

means for operatively connecting said oscillating means to said trowel member, said connection means including a first member pivotally attached along an axis transverse to said longitudinal axis at one end thereof to said oscillating means and at the other end thereof to said first end of said trowel member and a second member pivotally attached at one end to said oscillating means along an axis coincident with or parallel to said transverse axis and pivotally attached to said second end of said trowel member at the other end of said second member; the improvement comprising:

means operably connected to said intermediate portion of said trowel member and to said first member for selectively adjusting the effective weight of said trowel member with respect to the concrete being smoothed by said trowel member;

a balancing weight; and means for adjustably attaching said balancing weight to said trowel member for selectively balancing the trowel member about its transverse centerline, said transverse centerline of the travel member being substantially perpendicular to said longitudinal axis.

2. The apparatus of claim 1 wherein said adjusting means further comprises:

a flexible member attached to said intermediate portion of said trowel member;

an idler pulley connected to said first member at a point closer to said one end of the first member than to said second end thereof; and winch means connected to said flexible member and to said first member at a point closer to said second end thereof than to said first end thereof for selectively winding said flexible member onto or off from said winch means.

3. The apparatus of claim 2 wherein said flexible member includes a tension spring means whereby operating said winch means to wind said flexible member onto said winch means will lengthen said tension spring and reduce the effective pressure of said trowel member against the concrete it is smoothing and whereby operating said winch means to unwind said flexible member off of said winch means will shorten said tension spring and increase the effective pressure of said trowel member against the concrete it is smoothing.

4. The apparatus of claim 1 including:

turnbuckle means attached at one end thereof to said first end of said trowel member and attached at the other end thereof to said second end of said trowel member for selectively applying a force to push said first and second ends of said trowel member apart to thereby keep the bottom of said trowel member straight to aid in the concrete smoothing process.

5. The apparatus of claim 4 wherein said weight adjusting means comprises:

means for selectively and releasably securing said balancing weight to a portion of said turnbuckle means.

6. The apparatus of claim 5 wherein said weight adjusting means further comprises:

means for slidably attaching said balancing weight to said turnbuckle means.

7. Apparatus comprising:

a frame;

means for moving said frame in a forward direction;

means connected to said frame for slip forming concrete;

an elongated concrete smoothing trowel member having a longitudinal axis generally aligned with said direction of forward movement of said frame, said trowel members having a first end, a second end and an intermediate portion between the first and second end thereof;

means for oscillating said trowel member back and forth along said longitudinal axis;

means operably connected to a rear portion of said frame for moving said oscillating means and said trowel means transversely with respect to said longitudinal axis;

means for operatively connecting said oscillating means to said trowel member, said connection means including a first member pivotally attached along an axis transverse to said longitudinal axis at one end thereof to said oscillating means and at the other end thereof to said first end of said trowel member and a second member pivotally attached at one end to said oscillating means along an axis coincident with or parallel to said transverse axis and pivotally attached to said second end of said trowel member at the other end of said second member; the improvement comprising:

turnbuckle means attached at one end thereof to said first end of said trowel member and attached at the other end thereof to said second end of said trowel member for selectively applying a force to push said first and second ends of said trowel member apart to thereby keep the bottom of said trowel member straight to aid in the concrete smoothing process.

8. The apparatus of claim 7 further comprising:

a weight; and means for adjustably attaching said weight to said trowel member for selectively balancing the trowel member about its transverse centerline, said transverse centerline of the travel member being substantially perpendicular to said longitudinal axis.

9. The apparatus of claim 7, further comprising:

means operably connected to said intermediate portion of said trowel member and to said first member for selectively adjusting the effective weight of said trowel member with respect to the concrete being smoothed by said trowel member;

a flexible member attached to said intermediate portion of said trowel member;

an idler pulley connected to said first member at a point closer to said one end of the first member than to said second end thereof; and winch means connected to said flexible member and to said first member at a point closer to said second end thereof than to said first end thereof for selectively winding said flexible member onto or off from said winch means.

10. The apparatus of claim 9 wherein said flexible member includes a tension spring means whereby operating said winch means to wind said flexible member onto said winch means will lengthen said tension spring and reduce the effective pressure of said trowel member against the concrete it is smoothing and whereby operating said winch means to unwind said flexible member off of said winch means will shorten said tension spring and increase the effective pressure of said trowel member against the concrete it is smoothing.

* * * * *